United States Patent [19]

Stedman

[11] 4,034,855

[45] July 12, 1977

[54] SUSPENDED GUIDE ROLLERS

[75] Inventor: Robert N. Stedman, Chillicothe, Ill.

[73] Assignee: Caterpillar Tractor Co., Peoria, Ill.

[21] Appl. No.: 616,091

[22] Filed: Sept. 25, 1975

[51] Int. Cl.[2] ..... B66F 9/08

[52] U.S. Cl. ..... 187/9 E; 187/95

[58] Field of Search ..... 187/9 R, 9 E, 95; 308/2 R, 2 A, 3.8, 3 R, 6 R; 212/55; 182/103; 52/121

[56] References Cited

U.S. PATENT DOCUMENTS

| | | | |
|---|---|---|---|
| 2,083,502 | 6/1937 | Matthews | 187/95 |
| 2,260,922 | 10/1941 | Spiro | 187/95 |
| 2,881,031 | 4/1959 | Comfort | 308/6 R |
| 2,936,047 | 5/1960 | Quayle | 308/3.8 X |
| 3,070,190 | 12/1962 | Rogers et al. | 187/95 |
| 3,329,240 | 7/1967 | Harwood et al. | 187/95 |
| 3,506,092 | 4/1970 | Shinoda et al. | 187/9 E |
| 3,605,950 | 9/1971 | Goodacre | 187/9 E |
| 3,856,117 | 12/1974 | Solymos | 187/95 |
| 3,871,494 | 3/1975 | Kelly | 187/95 |

*Primary Examiner*—John J. Love
*Assistant Examiner*—James L. Rowland
*Attorney, Agent, or Firm*—Phillips, Moore, Weissenberger, Lempio & Majestic

[57] ABSTRACT

The invention is concerned with an improvement in a system for guiding a pair of generally vertical elements to travel linearly relative to one another, which system includes contact means supported by a first of said elements and maintaining contact with a second of said elements. The improvement of the invention comprises using as said contact means a suspension device supported at a position thereof by said first element and having a pair of spaced apart bearing means removed from the position of support of said device, each bearing against said second element.

7 Claims, 5 Drawing Figures

SUSPENDED GUIDE ROLLERS

BACKGROUND OF THE INVENTION

1. Field of the Invention

The invention is particularly concerned with the art of guiding pairs of generally vertical elements to travel linearly to one another. More particularly the invention is concerned with such a system which includes contact means generally in the form of rollers or the like supported by a first of said elements and maintaining contact with a second of said elements. Still more particularly the invention is concerned with an improved system for guiding a fork carrying carriage of a lift truck which forms a part of the mast assembly thereof upwardly and downwardly between flanged upright sections which also form a portion of said mast assembly.

2. Prior Art

In the lift truck art and in related arts wherein heavy loads are lifted generally vertically by forks, carriages, platforms, or the like which travel upwardly within a mast assembly having pairs of spaced apart uprights, rollers are generally provided which are directly rotatably attached to generally the carriage of a lift truck, for example, and which have the surfaces of said rollers contacting the inner uprights of the mast assembly. In this way, the carriage can move upwardly and downwardly without developing great frictional drag between the carriage and the mast assembly in which it rides. Often, the mast assemblies of lift trucks or the like have included one or more additional inner spaced apart upright members between the carriage and the fixed uprights and the rollers of the carriage have ridden within the inner upright members while the inner upright members themselves have had rollers extending outwardly therefrom generally at their bottoms to ride upon the interiors of the fixed uprights or upon other intermediate upright members whereby a telescoping effect has resulted allowing the carriage to ride upwardly to the total height of the inner upright members and further allowing the intermediate members themselves to travel upwardly to their respective heights within the fixed uprights.

A problem which has constantly existed in the art has been that the rollers, whether they be the rollers rotatably attached to and extending from the carriage or the rollers rotatably attached to and extending from the inner or intermediate upright members, have borne strongly against the respective one of the intermediate members or the fixed uprights thereby creating highly stressed contact areas with resulting flaking of the member being borne upon by the rollers. The present invention is concerned with a unique system for guiding generally vertical elements to travel linearly relative to one another whereby the amount of stress at each point of contact between rollers and vertical elements has been greatly reduced. It will be apparent that such guidance system is particularly useful when a telescoping system is utilized since in this instance when heavy loads are lifted well off the ground the stress which develops adjacent ground level is multiplied by the effective lever arm created by the additional extension provided by the telescoping means. Thus, the guiding system of the present invention is particularly useful in such applications as lift truck mast assemblies in which heavy loads are picked up and wherein these heavy loads are generally picked up from a position removed from the mast assemblies which situation tends to pull the rollers into hard contact with the elements in which they slide because the loads sit upon forks, platforms or the like extending from the carriage.

SUMMARY OF THE INVENTION

Briefly, the invention comprises an improvement in a system for guiding a pair of generally vertical elements to travel linearly relative to one another which includes contact means supported by a first of said elements and maintaining contact with a second of said elements. The improvement comprises using as the contact means a suspension device supported at a position thereof by the first element and having a pair of spaced apart bearing means removed from the position of support of said device, each bearing against said second element.

BRIEF DESCRIPTION OF THE DRAWINGS

The invention will be better understood by reference to the figures of the drawings wherein like numbers denote like parts throughout and wherein.

DETAILED DESCRIPTION OF THE PREFERRED EMBODIMENT

Figure 1:
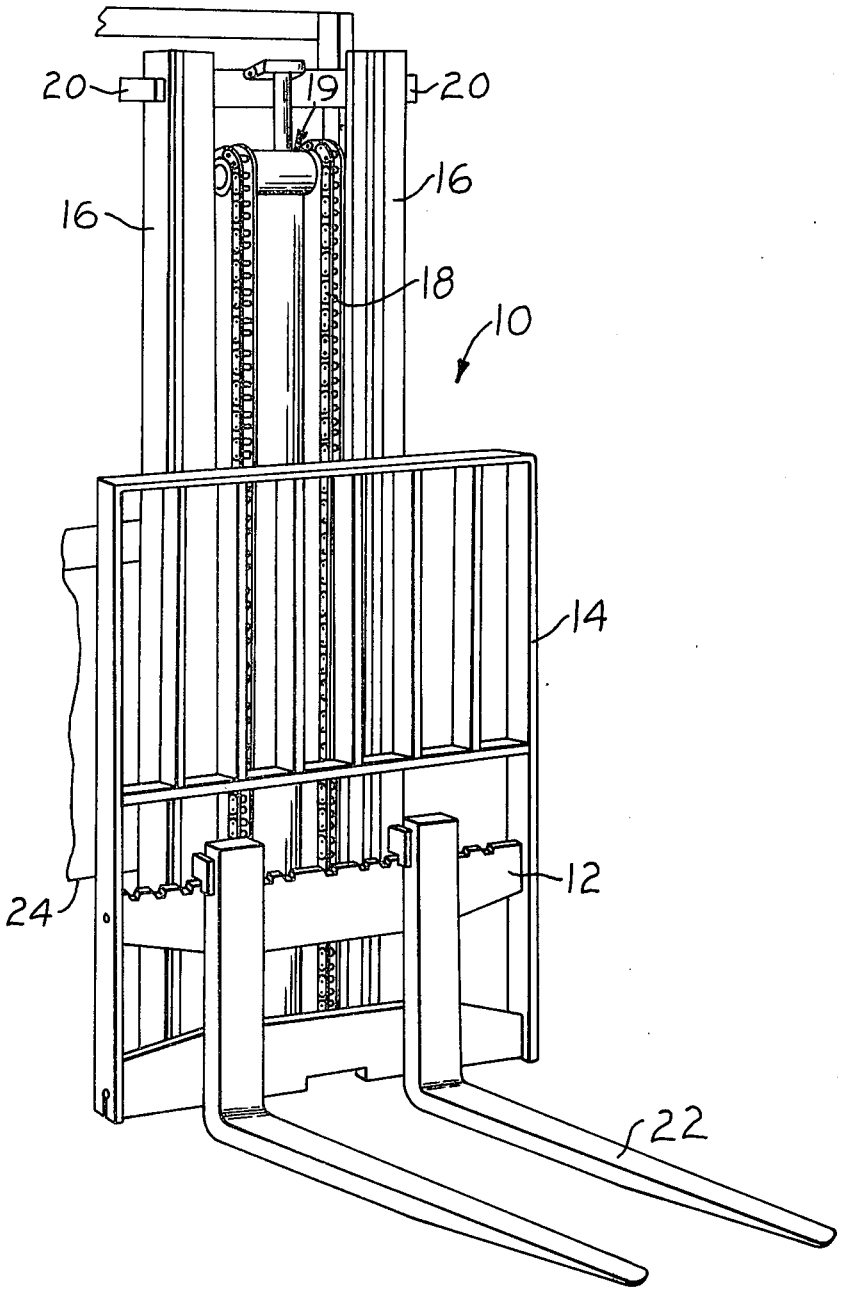
FIG. 1 illustrates in partial perspective view a lift truck mast assembly including a pair of upstanding masts and a carriage which travels linearly with respect to said masts.

Referring now specifically to the structure shown in the drawings, the preferred embodiment of the present invention is illustrated in detail. Referring first to FIG. 1, there is shown a lift truck mast assembly 10 which includes a carriage 12, a load backrest 14, a pair of fixed uprights 16, conventional lift chains 18 and a conventional lift cylinder assembly 19. The fixed uprights 16 are attached at their bottom ends to a lift truck and at their top ends are constrained together by a tie bar arrangement 20. The lift cylinder 19 provides motivating power for moving the carriage 12 relative to the masts 16 via the lift chains 18 in a conventional manner. A pair of forks 22 extend forwardly from the carriage 12. A frame 24 provides support for the fixed uprights 16. Intermediate the fixed uprights 16 and the carriage 12, as will be seen in FIGS. 2 and 3 is a slidable member, namely an inner upright 26 which is movable relative to the fixed uprights 16 under the impetus of the lift cylinder 19.

In the embodiment as illustrated in the figures of the drawings there are shown two pairs of generally vertical elements which travel linearly relative to one another. First, there is the carriage 12 which moves linearly relative to the inner uprights 26. Secondly, there are the inner uprights 26 which travel linearly relative to the fixed uprights 16. It should be understood that additional pairs of generally vertical elements (intermediate uprights) can be added to this structure in a conventional manner without deviating from the practice of the present invention. Overall of course, what results is that the carriage 12 moves generally vertically linearly relative to the fixed uprights 16 and relative to the inner uprights 26. As will be seen, contact means are supported by a first of the generally vertically linearly movable elements, for example, by the carriage 12, said contact means comprising in the preferred embodiment a suspension device 30 as is illustrated most clearly in FIGS. 4 and 5.

Figure 2:
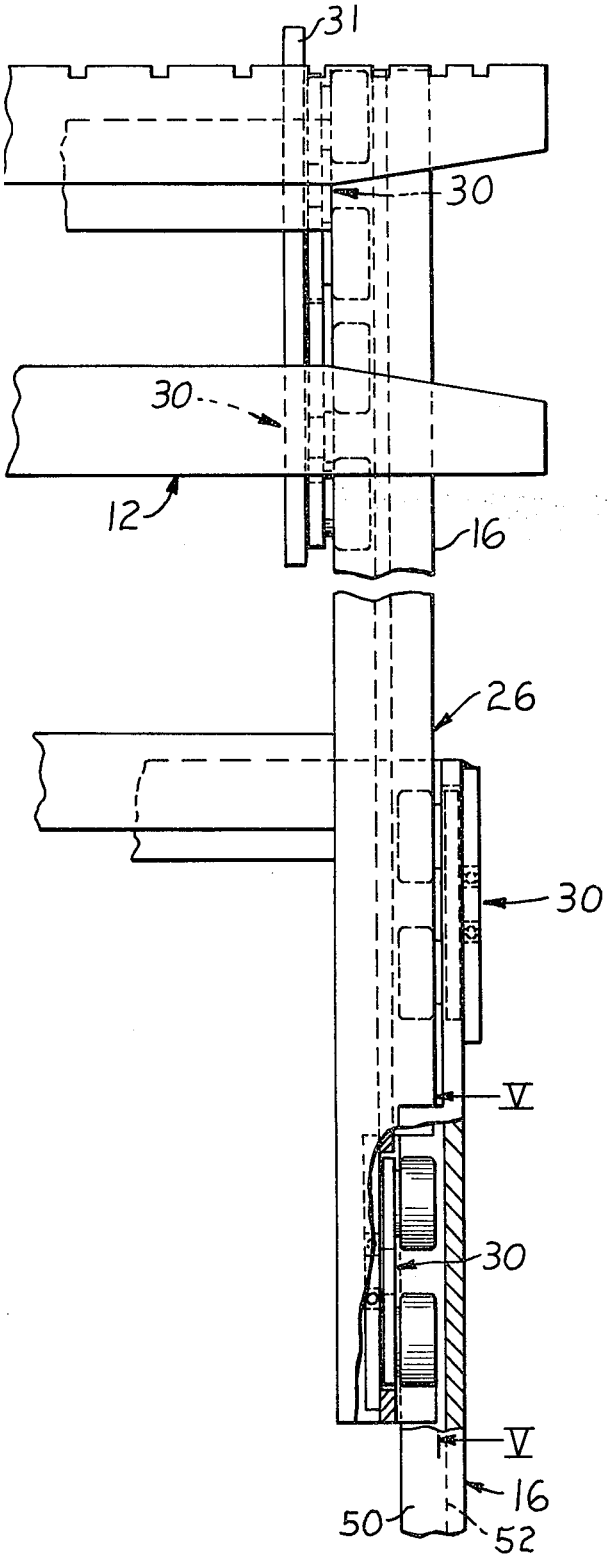
FIG. 2 illustrates in front elevation, partially broken away and partially in section, approximately one half of a mast assembly as illustrated in FIG. 1 with the carriage thereof extended upwardly relative to the mast thereof.
Figure 3:
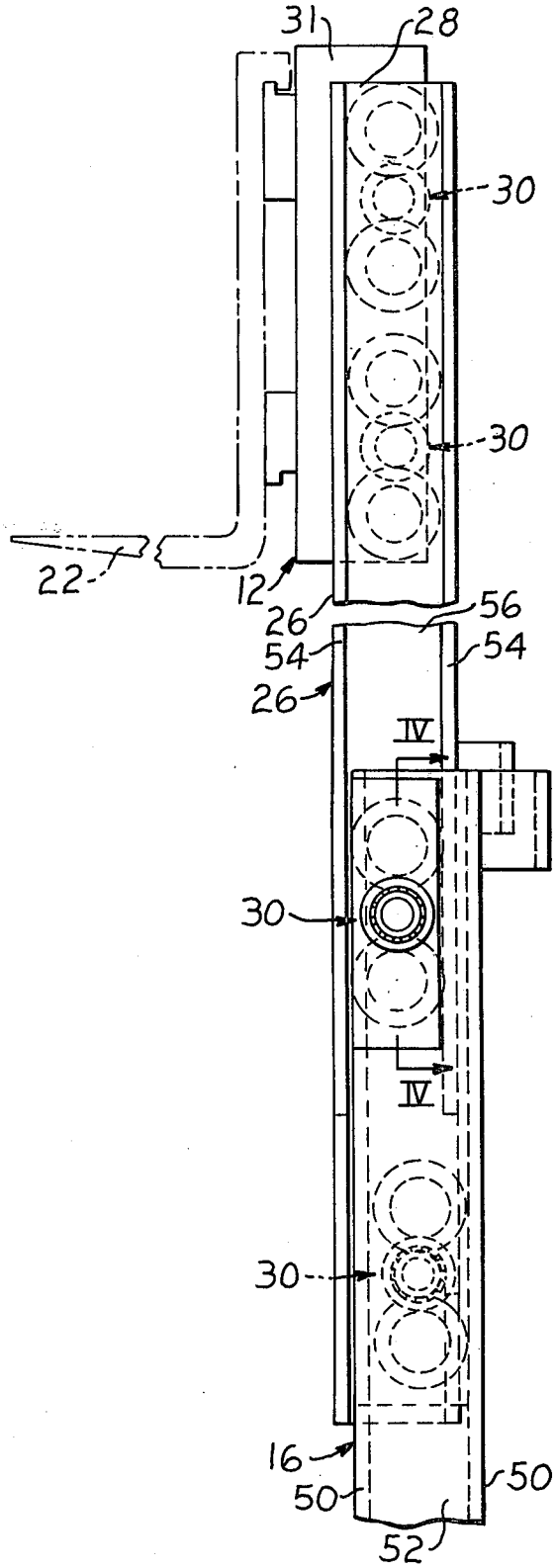
FIG. 3 illustrates in side elevation view the partial mast assembly as shown in FIG. 2.
Figure 5:
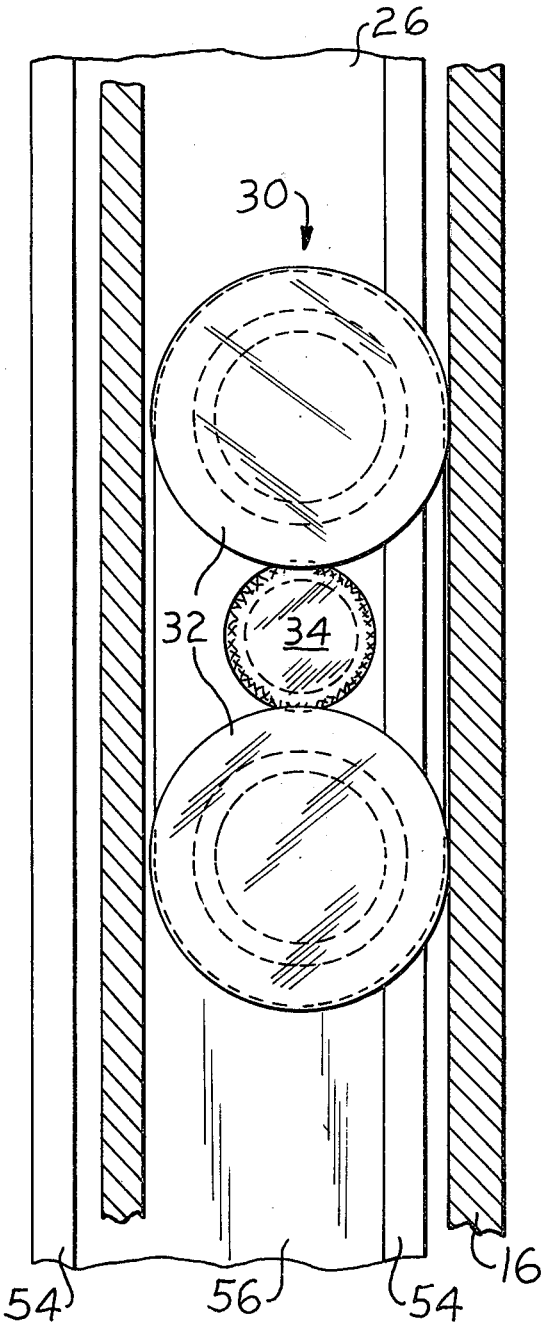
FIG. 5 illustrates a view taken in the direction V—V of FIG. 2.

In a lift truck mast assembly or the like as illustrated in FIG. 1, it is clear that there are a pair of first generally vertical elements, e.g., a pair of side bars 31, one of which is illustrated in FIGS. 2 and 3, a pair of second elements, e.g. the pair of the inner uprights 26, one of which is also illustrated in FIGS. 2 and 3 and in FIG. 5 as well, and the pair of fixed uprights 16 illustrated in each of the Figures of the drawings. In such an assembly it is clear that there are a pair of pairs of generally vertical elements, e.g., the pair of side bars 31 and the pair of inner uprights 26 or the pair of inner uprights 26 and the pair of fixed uprights 16, which travel linearly relative to one another. Further, it is clear that the carriage 12 serves as means for constraining the side bars 31 to travel together, the tie bar arrangement 20 serve a similar purpose for the fixed uprights 16 and the inner uprights 26 are also constrained by the tie bar arrangement 20.

Figure 4:
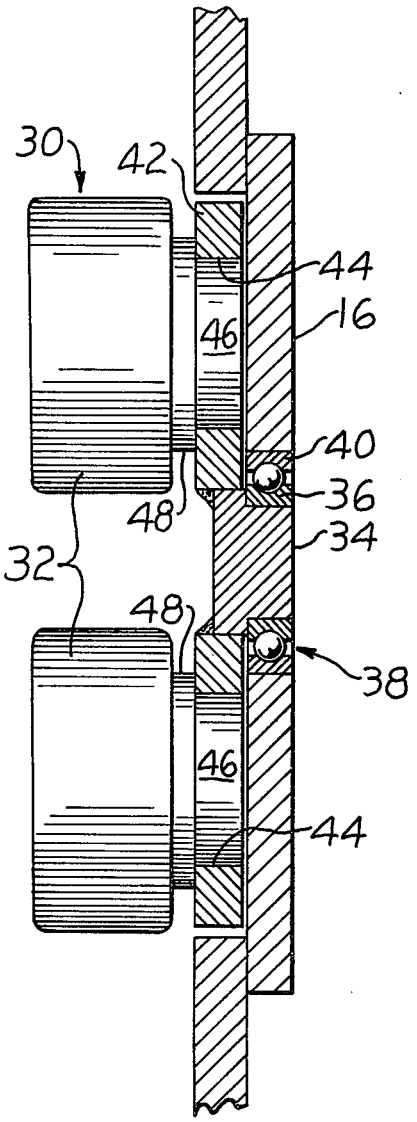
FIG. 4 illustrates a view taken along the line IV—IV of FIG. 3.

The suspension device 30 includes a pair of spaced apart bearing members, in the preferred embodiment of the invention a pair of equally spaced rollers 32 each removed from a position of support of the device, in the embodiment illustrated each equally removed from the pivot 34 as will be most clearly seen by reference to FIGS. 4 and 5. The pivot 34 may simply consist of a shaft supported by the inner race 36 of a ball bearing assembly 38, the outer race 40 of which is fixedly held, for example, in a press fit, by one of the linearly vertically movable elements, in FIG. 4 by the fixed uprights 16 and in FIG. 5 by the inner upright 26. As will be seen most clearly by reference to FIGS. 2 and 3, one suspension device 30 can be supported by one of the vertical elements, for example, by the inner upright 26, while another of the suspension devices 30 can be supported by another of the generally vertical elements, for example, by the fixed uprights 16. As is also illustrated in FIGS. 2 and 3 a single generally vertical element, for example, the carriage 12, can support two of the suspension devices 30 thus providing four position support, one position for each roller 32.

Turning now to the suspension devices 30 themselves and most particularly to the suspension devices 30 as shown in FIGS. 4 and 5, it will be noted that each of said suspension devices 30 includes an elongated member 42 having a pair of bores 44 disposed therein adjacent opposite ends thereof. A pair of shafts 46 sit and are generally rigidly affixed within the bores 44 and extend from said bores 44. The rollers 32 are rotatably mounted at the shafts 46 or more particularly at an extension 48 of the shafts 46. The elongated member 42 is pivotally suspended intermediate the bores 44 from a respective one of the generally vertical elements, i.e., a respective one of the carriage 12, the fixed uprights 16, and the inner movable uprights 26, as by the pivot 34 as previously explained.

Although not illustrated, it is clear that the suspension device can further include a second elongated member on an opposite side of said rollers from said elongated member 42 to provide added strength.

As may be readily noted, particularly from FIGS. 2, 3 and 5, the fixed uprights 16 comprise flanged upright sections of the mast assembly 10. Similarly, the inner uprights 26 comprise flanged upright sections of the mast assembly 10 as is clearly shown in FIGS. 2, 3 and 5. Thus, the fixed uprights 16, each include a pair of legs 50 and a bridge 52 and the inner uprights 26 each include a pair of legs 54 and a bridge 56.

While the invention has been described in connection with specific embodiments thereof, it will be understood that it is capable of further modification, and this application is intended to cover any variations, uses or adaptations of the invention following, in general, the principles of the invention and including such departures from the present disclosure as come within known or customary practice in the art to which the invention pertains and as may be applied to the essential features hereinbefore set forth, and as fall within the scope of the invention and the limits of the appended claims.

That which is claimed is:

1. In a system for guiding a first pair of elements of a pair of pairs of generally vertical elements to travel linearly relative to a second pair of elements of said pair of pairs, said second pair of elements comprising a pair of flanged upright members of a mast assembly, each of which comprises a pair of legs joined together by a bridge, which include means for constraining said first pair of elements to travel together, means for constraining said second pair of elements to travel together and contact means supported by said first pair of elements and maintaining contact with said second pair of elements, the improvement comprising using as said contact means:

a first pair of suspension devices one of which is supported by said first pair of elements, each suspension device having a first pair of spaced apart rollers removed from a respective position of support of each of said first pair of suspension devices positioned between the legs of and bearing against a respective one of said flanged upright members comprising said second pair of elements, each of said first suspension devices including an elongated member having a pair of bores disposed therein adjacent opposite ends thereof; a pair of shafts held within and extending from said bores; said rollers being rotatably mounted at said shaft; and means for pivotally suspending said elongated member intermediate said bores from said first pair of elements to equally distribute forces exerted on said first pair of elements by weight being lifted thereby to each of said rollers and thereby to each of said second pair of elements.

2. An improvement as in claim 1, wherein said first pair of elements and said second pair of elements together comprise a lift truck mast assembly.

3. An improvement as in claim 2, wherein said first pair of elements and said constraining means therefor comprise a carriage of a lift truck.

4. An improvement as in claim 3, including a plurality of pairs of said first suspension devices vertically displaced from one another along said carriage to equally distribute forces exerted on said carriage by weight being lifted thereby to each of the rollers of each of said plurality of pairs of said first suspension devices.

5. An improvement as in claim 3, including a third pair of elements on an opposite side of said flanged upright sections of said mast assembly from said carriage and a second pair of suspension devices each supported by a respective one of said third pair of elements and said flanged upright sections, each suspension device having a second pair of spaced apart rollers removed from a position of support of each of said second pair of suspension devices bearing against a respective other of said third pair of elements and said flanged upright sections.

6. An improvement as in claim 5, wherein each of said second suspension devices includes an elongated member having a pair of bores disposed therein adjacent opposite ends thereof; a pair of shafts held within and extending from said bores, said rollers being rotatably mounted at said shaft; and means for pivotally suspending a respective one of said elongated members intermediate said bores from a respective one of said flanged upright sections and said third pair of elements and means for pivotally suspending a respective other of said elongated members intermediate said bores from a respective on of said carriage and said flanged upright sections.

7. An improvement as in claim 6, including a plurality of pairs of said first suspension devices vertically displaced from one another along said carriage to equally distribute forces exerted on said carriage by weight being lifted thereby to each of the rollers of each of said plurality of pairs of said first suspension devices.

* * * * *